United States Patent [19]

Magnusson

[11] Patent Number: 4,984,694

[45] Date of Patent: Jan. 15, 1991

[54] COMBINED STRING BASKET AND STRING SHELF SYSTEM

[75] Inventor: Reine Magnusson, Bålsta, Sweden

[73] Assignee: Sparring Elfa AB, Vallingby, Sweden

[21] Appl. No.: 293,331

[22] Filed: Jan. 4, 1989

[51] Int. Cl.[5] ..... A47F 43/00

[52] U.S. Cl. ..... 211/186; 211/133

[58] Field of Search ..... 211/126, 181, 133, 153, 211/186

[56] References Cited

U.S. PATENT DOCUMENTS

| | | | |
|---|---|---|---|
| 2,008,315 | 7/1935 | Schmidt | 211/153 |
| 2,926,022 | 2/1960 | Nau et al. | 211/133 X |
| 3,184,075 | 5/1965 | Cohen | 211/186 |
| 3,280,989 | 10/1966 | Melvin et al. | 211/133 |
| 3,371,796 | 3/1968 | Crouch et al. | 211/153 X |
| 4,597,616 | 7/1986 | Trubiano | 211/181 X |

*Primary Examiner*—David M. Purol
*Assistant Examiner*—Sarah Lechok
*Attorney, Agent, or Firm*—Nilles & Nilles

[57] ABSTRACT

A combined string basket and shelf system comprising at least one string basket stand (1, 2) of known type and being formed as an open stand having vertical stand tubes or corner posts (3, 4) and having slide bars (10, 11) for receiving projecting frame portions of string baskets (6) or boxes, and forming a first one of two connection elements for one or more connection and stabilization elements (9), and spaced from said string basket stand (1 or 2) a second connection element for another part of the connection and stabilization elements (9), which is a string shelf (9) having cross strings and longitudinal strings (14, 15), whereby the string shelf (9), via any optional cross string (14) and with the assistance of clips (16), can be connected easily releasably to any one of the longitudinal slide bars (10, 11) of the basket stand or stands (1, 2), and in which the string shelf, for bridging an exactly desired distance, extends a short or a long distance inside the stand entering between the vertical front and rear stand tubes (3, 4) and eventually between horizontal cross bars (7, 8) which connect the vertical stand tubes (3, 4) with each other at the front side and the rear side of the stand.

7 Claims, 3 Drawing Sheets

COMBINED STRING BASKET AND STRING SHELF SYSTEM

The present invention generally relates to a combined string basket and string shelf system comprising at least one string basket stand which forms, on one side thereof, a means for mounting one or more string shelves, and spaced from said string basket stand mounting means for another part of the string shelf or string shelves. By a string basket stand is of known type formed as an open unit and the means for mounting one or more string shelves includes slide bars for receiving projecting frame parts of string baskets or string boxes.

BACKGROUND OF THE INVENTION

String baskets in basket stands of the above mentioned type are commonly used for domestic appliances, in shops, offices, stores and many other places, and they are generally placed free-standing or with one side part or rear part thereof in contact with a wall. Such strings baskets mounted in stands are also often used as fittings in wardrobes to form deposit spaces for an entire wall area, or as a fitting for a cupboard having swing-doors or sliding-doors.

When basket stands of the above mentioned type are placed free-standing, i.e. without any anchoring in a wall or in the floor, they are sometimes considered too easily side-displacable, and in such cases it can often be desirable to interconnect several basket stands in a successive row thereby improving the total stability of the system. In some cases it is, however, preferred that there is a certain space between the basket stands of a system, for instance for making it possible to hang coats, dresses and suits etc; in other cases it may be desired to have a higher space available than a basket stand can give, and in such cases it may also be preferred to provide only one shelf or a couple of shelves between two adjacent basket stands. Sometimes the available standard widths of basket stands are not sufficient for filling up the space from wall to wall in a storing space, whereby there will be a waste space having a width of only some few decimeters.

SUMMARY OF THE INVENTION

The present invention is intended to provide an improved flexibility in a string basket system of the above mentioned, previously known type, by means of which system two spaced string basket stands can be interconnected thereby giving the total system an improved stability. The means for interconnecting make possible to practically completely fill up any predetermined space width with string baskets; and thus it is possible to but the total system, including string baskets and string shelves, in a cupboard, a wardrobe, a storing place etc. having any width.

According to the invention this ability to but practically any width is made possible by means of a string shelf having longitudinal and cross strings, whereby the string shelf, by means of clips, can be easily relesably mounted on longitudinal slide bars or support bars presented by the string baskets stands, and whereby the string shelf may extend at least some distance inside the stand entering between front and rear stand tubes or posts and eventually between horizontal cross bars which interconnect said vertical stand tubes at the front and the rear sides of the stand. By optionally selecting particular cross strings of the string shelf, any optional distance between two string basket stands or between the outer side of one basket stand and a wall can be bridged, so that a predetermined space width is practically completely filled up, and provide the entire basket/shelf system with a good stability.

Further characteristics and advantages of the invention will be evident from the following detailed description, in which reference will be made to the accompanying drawings. It is, however, to be understood that the described and illustrated embodiments of the invention are only examples of the invention, and that many modifications and variations may be presented within the scope of the appended claims.

DESCRIPTION OF THE PREFERRED EMBODIMENT

Figure 1:
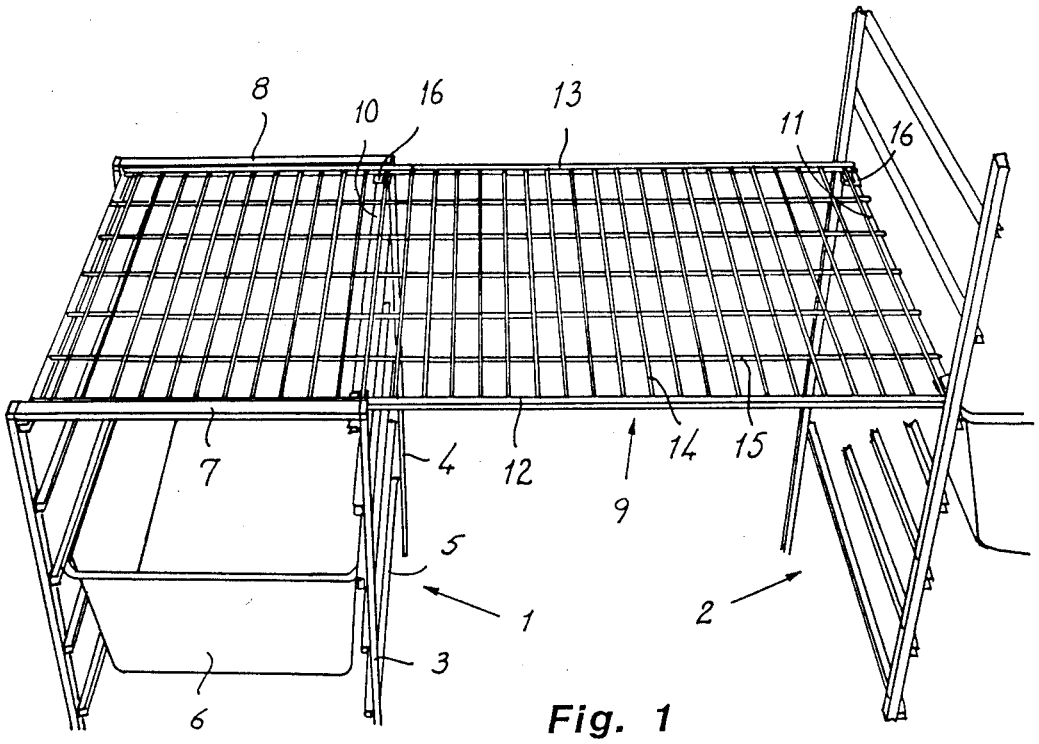
FIG. 1 shows a stand/shelf system comprising two spaced string basket stands and an intermediate string shelf.

The system shown in FIGS. 1–5 generally comprises two spaced string basket stands and an intermediate, bridging string shelf.

The string basket stands 1 and 2 are of known type constitute first and second connection means. The basket stands 1 and 2 are formed with front and rear corner tubes or posts 3 and 4 resp., and with slide bars 5 receiving string support units such as baskets or string shelves 6, inside the area of the string baskets to extending between said corner posts, which slide bars on both sides are, as is conventional, positioned at the same mutual height. The left string basket stand 1 shown in FIG. 1 is lower than the right stand 2, and it is evident that the stand corner tubes 3 and 4 are interconnected at their upper ends by front and rear cross bars 7 and 8.

Figure 4:
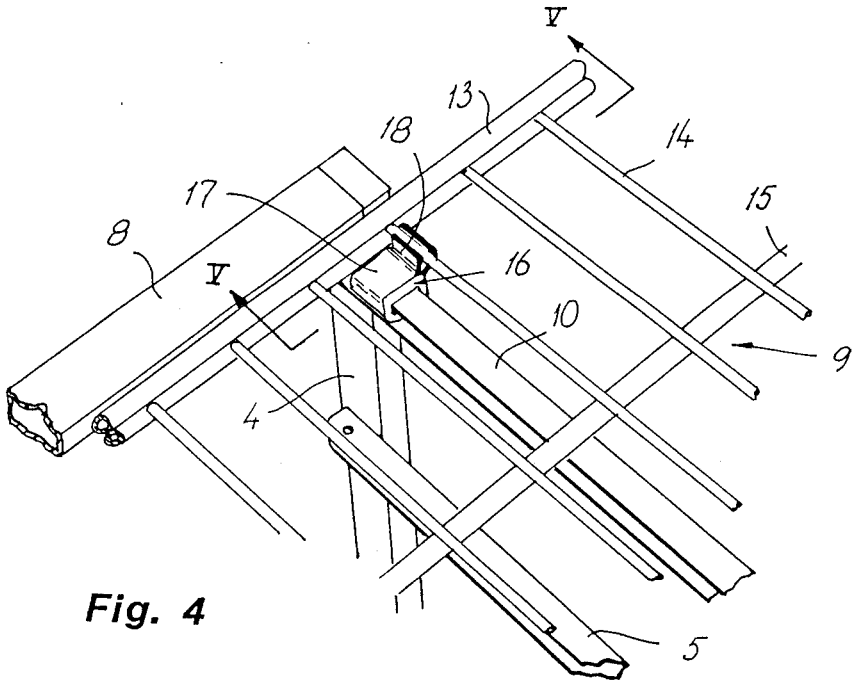
FIG. 4 shows, more in detail, the mounting system operative between the string shelf and a slide bar of the string basket stand.
Figure 5:
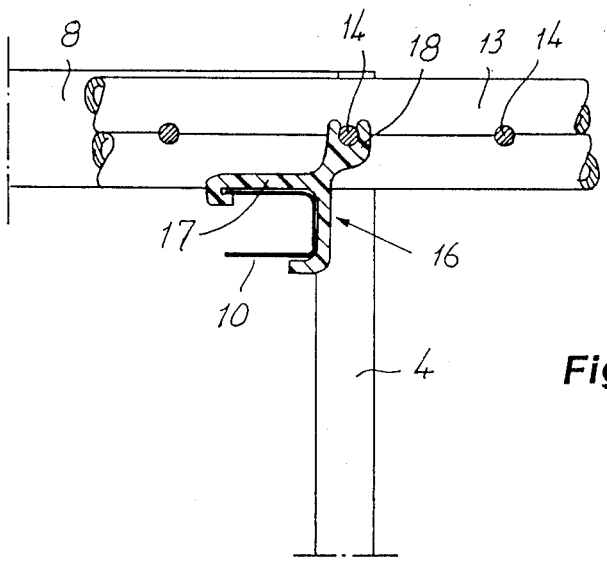
FIG. 5 shows, in a larger scale, a cross section along line V—V of FIG. 4.

In the illustrated case the two string basket stands are interconnected by a connection and stabilization means in the form of string shelf 9, which shelf, by means of suitable clips 16, is mounted on top of slide bars 10 and 11 of the basket stand. The string shelf 9 comprises longitudinal, outer frame parts or tubes 12 and 13, cross strings 14 extending between said frame tubes, and longitudinal connection strings 15. The cross strings 14, which are provided on relatively short distances from each other are used for mounting of the string shelf on top of the slide bars 10 and 11, and as best illustrated in FIGS. 3–5 this is made by means of clips 16 comprising a lower clip part 17 of an underliying U-shape, which clip part 17 can be clamped over a slide bar 10 without impeding a displacement of a string basket or a string shelf provided in said slide bar, and an upper clip part 18 of U-shape which is integral with the lower clip part 17 and in which a cross string 14 of a string shelf 9 can be clamped.

It is evident that the string shelf 9 has in the illustrated case a width which corresponds to the inner distance between the vertical stand tubes 3 and 4, and that the string shelf is clamped between said stand tubes 3 and 4 and between the horizontal cross bars 7 and 8, so that the shelf 9 and the string basket stand 1 provides a well interconnected unit.

Figure 2:
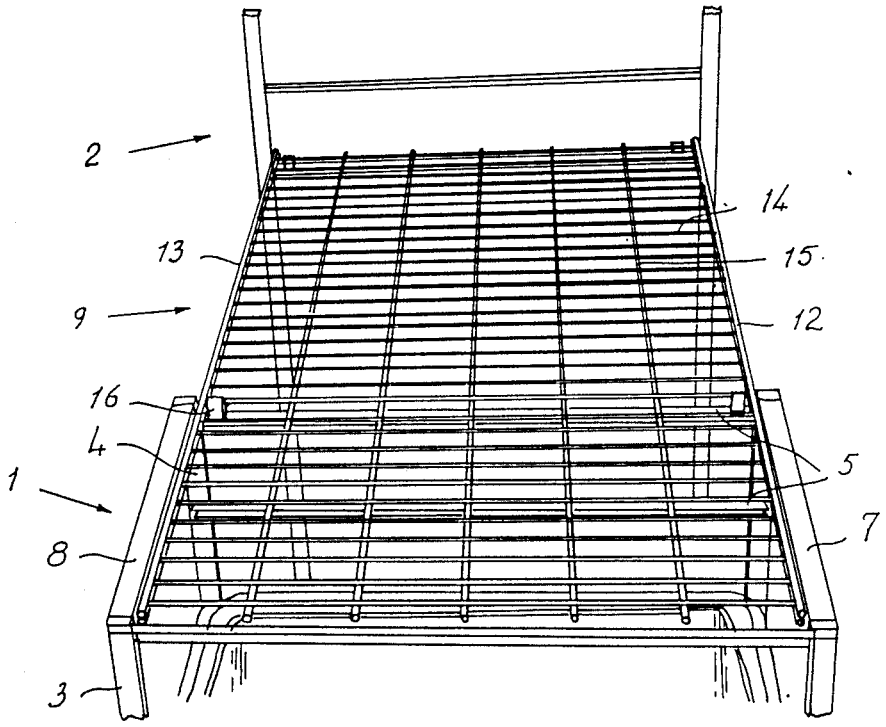
FIG. 2 shows the same system seen from the left side of FIG. 1.
Figure 3:
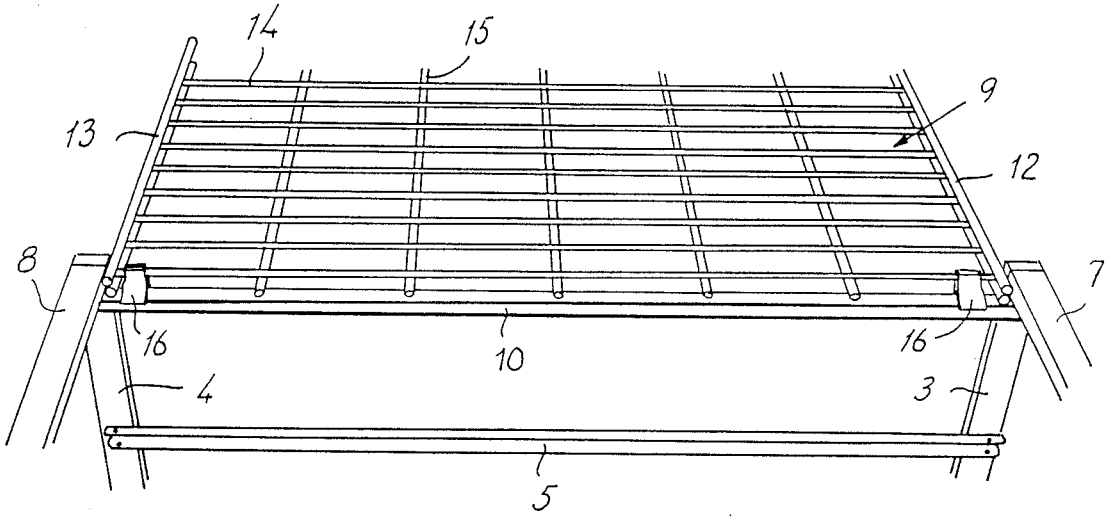
FIG. 3 shows the stand/shelf system shown in FIG. 2 but with the string shelf mounted in its outermost position.

It is obvious that the string shelf 9 can be mounted on the basket stand by means of any one of the cross strings 14, and FIGS. 1 and 2 illustrate an extreme position, in which the string shelf extends over the entire left basket stand, whereas FIG. 3 shows another extreme position, in which the string shelf is mounted on the left basket stand 1 via the outermost cross string 14 of the string shelf. It should be noted that the string shelf, without obstacles from any string baskets or string shelves, present in the slide bars 10 and 11, can be mounted so that as to extend a short or a long distance inside one of or both string basket stands 1 and 2. It is also obvious that several string shelves can be placed on different levels above each other between the string basket stands.

Figure 6:
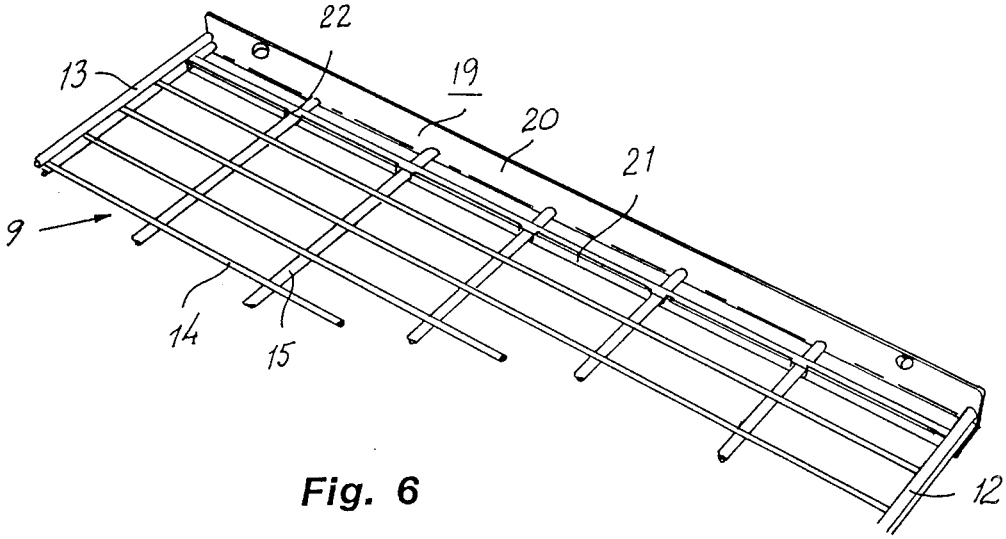
FIG. 6 shows the outer end portion of a string shelf supported by a console which is secured to a wall.

The string shelf 9, or the string shelves, can be placed, either between a string basket stand and an ordinary shelf console (not shown in the drawings) in which case the string shelf is secured by means of clips, or between a string basket stand and a console 19 which is secured to a wall, as diagrammatically shown in FIG. 6. The wall console 19 is formed as a U-bar, one branch 20 of which is adapted to be screw connected to the wall or any other end-object, and the other branch 21 of which is formed with grooves 22 for the longitudinal shelf strings 15. The outermost cross string 14 thereby becomes secured between said first and second console branches 21 and 22.

It is also obvious that a string shelf 9 may very well be cut anywhere between cross strings 14, so that the shelf gets an exact length in case it is desired to accomodate the length of the shelf 9 and the total length of the integral unit provided by the combination of the string basket stand or a similar means and string shelves.

What is claimed is:

1. A combined string basket and shelf system comprising:

a first and second connecting means (1, 2) longitudinally spaceable from each other at any overall selected distance, at least one said connecting means comprising a string basket stand having front and rear portions and including spaced apart front and rear stand tubes (3, 4) interconnected by one or more slide bars (5, 10, 11) that extend horizontally therebetween to provide an inside area having a longitudinal width, a support unit having projecting frame portions, said slide bars receiving said projecting frame portions of said support unit (6) and being mountable in said inside area;

one or more connection and stabilization means (9) for interconnecting said first and second connecting means, each of said connection and stabilization means including a longitudinally extending string shelf (9) having a plurality of cross strings (14) extending front to rear and spaced apart from each other along said longitudinal extent thereof, said string shelf being free to be moved in longitudinal directions relative to said connection and stabilization means to extend into said inside area for a variable distance that will result in said connection and stabilization means and and string shelf having a combined overall longitudinal width that will bridge said selected distance;

clip means (16) mounted on one or more of said slide bars for releasably receiving and holding that one of said plurality of cross strings which is in alignment therewith after said string shelf has been positioned to bridge said selected distance at which said first and second connecting means are spaced apart ; and said clip means when in an installed condition holding said one cross string to prevent any further movement between said string shelf and said first and second connecting means in either of said longitudinal directions to stabilize said system at any overall width bridging said selected distance.

2. A system according to claim 1 wherein said clip means comprises:

a first lower clip part (17) having a U-shape in section adapted to be clamped to any one of said slide bars; and a second upper clip part (18) having, in section, a U-shape opening upward and dimensioned to releasably receive any of said cross strings therein.

3. A system according to claim 1 wherein said string shelf is dimensioned to fit between said front and rear stand tubes.

4. A system according to claim 1 wherein said first connecting means for said string shelf (9) is the string basket stand, and wherein second connecting means is a console (19) securable to an end surface.

5. A system according to claim 4 wherein said string shelf also has longitudinally extending strings (15); and said console (19) comprises a U-bar of U-shape in section having one branch (20) securable to said end surface and another branch (21) having grooves (22) spaced apart from front to rear for accommodating said longitudinal strings (15) of the string shelf (9) to stabilize said string shelf against front to rear movement, said another branch being spaced from said one branch to define a cross string receiving channel with said another branch (21) being a stop means for said cross string (14) positioned in said channel to stabilize said string shelf against longitudinal movement.

6. A system according to claim 1 wherein said one connecting means for the string shelf (9) is a string basket stand, and wherein said second connecting means is a shelf console (19) in which the string shelf is mounted by clip means (16).

7. A system according to claim 6 wherein said clip means comprises:

a first lower clip part (17) having a U-shape in section adapted to be clamped to any one of said slide bars; and a second upper clip part (18) having, in section, a U-shape opening upward and dimensioned to releasably receive any of said cross strings therein.

* * * * *